US011473490B2

(12) United States Patent
Leck et al.

(10) Patent No.: US 11,473,490 B2
(45) Date of Patent: Oct. 18, 2022

(54) FLOW CONTROL DEVICE FOR A COOLING SYSTEM

(71) Applicant: Ford Global Technologies, LLC, Dearborn, MI (US)

(72) Inventors: Chris Leck, Enfield (GB); Kit Bancroft, Newport Pagnell (GB); Duncan Scholtes, London (GB)

(73) Assignee: Ford Global Technologies, LLC, Dearborn, MI (US)

( * ) Notice: Subject to any disclaimer, the term of this patent is extended or adjusted under 35 U.S.C. 154(b) by 35 days.

(21) Appl. No.: 17/015,746

(22) Filed: Sep. 9, 2020

(65) Prior Publication Data

US 2021/0115837 A1 Apr. 22, 2021

(30) Foreign Application Priority Data

Sep. 26, 2019 (GB) ..... 1913871

(51) Int. Cl.
*F01P 7/14* (2006.01)
*F01P 3/02* (2006.01)
(Continued)

(52) U.S. Cl.
CPC ..... *F01P 7/14* (2013.01); *F01N 13/10* (2013.01); *F01P 3/02* (2013.01); *F01P 3/20* (2013.01);
(Continued)

(58) Field of Classification Search
CPC ..... F01P 7/14; F01P 3/02; F01P 3/20; F01P 5/12; F01P 11/08; F01P 2003/024;
(Continued)

(56) References Cited

U.S. PATENT DOCUMENTS 5,408,965 A * 4/1995 Fulton ..... F01M 5/002 123/196 AB
2013/0056077 A1* 3/2013 Eva ..... F01P 7/16 137/1
(Continued)

FOREIGN PATENT DOCUMENTS

DE 102016010363 B3 2/2018
EP 2876274 A1 5/2015

OTHER PUBLICATIONS

Great Britain Intellectual Property Office, Combined Search and Examination Report under Sections 17 and 18(3) Issued in Application No. GB1913871.8, dated Feb. 20, 2020, 7 pages.

*Primary Examiner* — Jacob M Amick
(74) *Attorney, Agent, or Firm* — Vincent Mastrogiacomo; McCoy Russell LLP

(57) ABSTRACT

Methods and systems are provided for a flow controller for an engine cooling system is provided. The flow controller comprises a chamber for receiving coolant flowing through the engine cooling system; a first aperture for coolant to flow into or out of the chamber; a first valve for controlling the flow of coolant through the first aperture according to a pressure of the coolant to flow through the first aperture; a second outlet for coolant to flow into or out of the chamber; and a second valve for controlling the flow of coolant through the second outlet according to the pressure of the coolant to flow through the second aperture, wherein the first and second apertures are inlets, for coolant to flow into the chamber though the first and second apertures, or the first and second apertures are outlets, for coolant to flow out of the chamber though the first and second apertures.

19 Claims, 9 Drawing Sheets

(51) Int. Cl.

| | |
|---|---|
| ***F01P 5/12*** | (2006.01) |
| ***F01N 13/10*** | (2010.01) |
| ***F01P 3/20*** | (2006.01) |
| ***F01P 11/08*** | (2006.01) |

(52) U.S. Cl.
CPC ..... *F01P 5/12* (2013.01); *F01P 11/08* (2013.01); *F01P 2003/024* (2013.01); *F01P 2007/146* (2013.01); *F01P 2025/04* (2013.01); *F01P 2025/08* (2013.01); *F01P 2060/04* (2013.01)

(58) Field of Classification Search
CPC ..... F01P 2007/146; F01P 2025/04; F01P 2025/08; F01P 2060/04; F01N 13/10
See application file for complete search history.

(56) References Cited

U.S. PATENT DOCUMENTS

| | | | | |
|---|---|---|---|---|
| 2015/0037177 | A1* | 2/2015 | Buchholz | F01P 5/12 417/319 |
| 2017/0182866 | A1* | 6/2017 | Onishi | B60H 1/00778 |
| 2019/0277183 | A1* | 9/2019 | Bauer | F01P 5/12 |

* cited by examiner

FLOW CONTROL DEVICE FOR A COOLING SYSTEM

CROSS REFERENCE TO RELATED APPLICATIONS

The present application claims priority to Great Britain Patent Application No. 1913871.8 filed on Sep. 26, 2019. The entire contents of the above-listed application is hereby incorporated by reference for all purposes.

FIELD

The present description relates generally to flow control devices for engine cooling systems for enhancing engine warm-up.

BACKGROUND/SUMMARY

Engine assemblies may comprise a cooling system for circulating coolant between the components of the engine assembly, in order to maintain the temperatures of the engine assembly components within respective desirable operating temperature ranges.

It may be desirable to reduce the time taken for components of an engine assembly to warm-up to their desirable operating temperatures following engine start up. However, the operation of the engine cooling system may conflict with this desire to achieve fast engine warm up, if coolant is circulated to the components during engine warm-up.

It is therefore desirable to operate the engine cooling system in such a way that permits the components of the engine assembly to quickly reach their desirable operating temperatures after the engine has been started.

In one example, the issues described above may be addressed by a flow controller for an engine cooling system, the flow controller comprising a chamber for receiving coolant flowing through the engine cooling system, wherein the chamber is mounted to an engine housing adjacent to an outlet of the engine cooling system, a first aperture configured to flow coolant out of the chamber, a first valve configured to adjust coolant flow through the first aperture based on a coolant pressure, a second aperture configured to flow coolant out of the chamber, and a second valve configured to adjust coolant flow through the second aperture based on the coolant pressure, wherein the first valve is configured to open in response to the coolant pressure being greater than a first pressure and less than a second pressure, and wherein the second valve is configured to open in response to the coolant pressure being greater than a second pressure, wherein the second pressure is greater than the first pressure. In this way, electronic valves may be omitted, which may decrease a manufacturing cost of the flow controller.

As one example, a pressure of the coolant is passively set based on engine rotations per minute (RPM). That is to say, a coolant pump may be driven by the engine, wherein the pressure of the coolant increases as the engine RPM increases. Additionally or alternatively, the coolant pump may be at least partially electrically driven, wherein the pressure is based on a temperature of the coolant. By doing this, valves in the flow controller may be actuated in response to the coolant pressure, thereby eliminating a demand for electrically actuated valves while still being able to decrease a cold-start duration.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
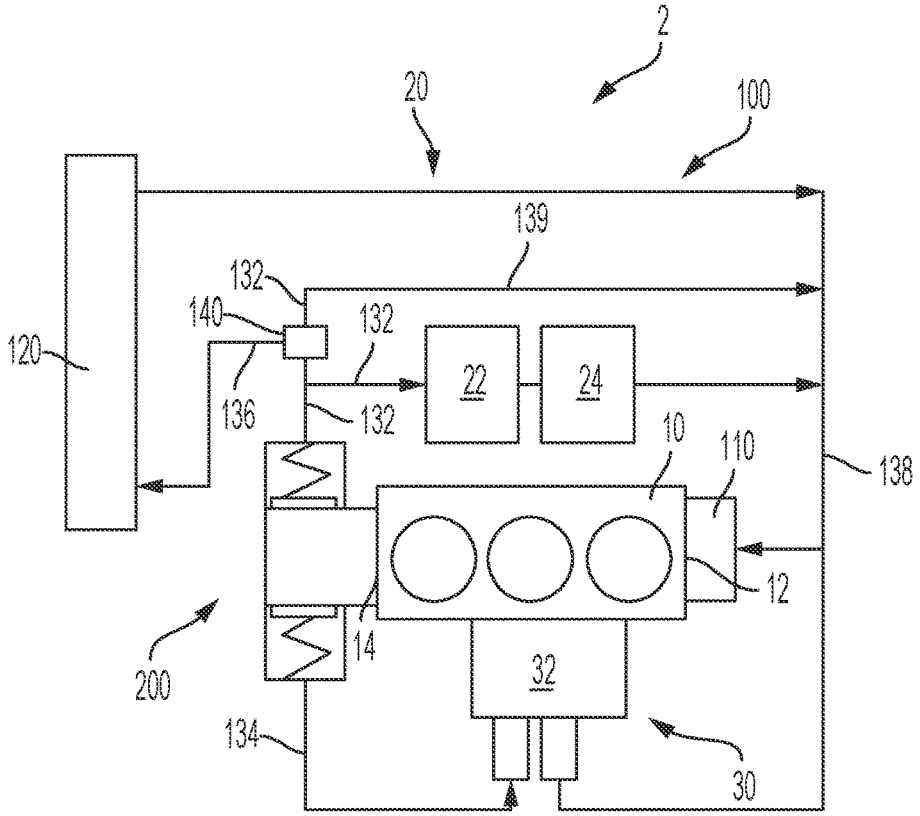
FIG. 1 shows a schematic view showing an engine assembly comprising a cooling system, according to an arrangement of the present disclosure.

The following description relates to systems and methods for a flow controller for an engine cooling system, the flow controller comprising a chamber for receiving coolant from a coolant outlet of an engine housing, a first outlet from the chamber, a first valve for controlling the flow of coolant from the chamber through the first outlet according to a pressure of the coolant within the chamber, a second outlet form the chamber; and a second valve for controlling the flow of coolant from the chamber through the second outlet according to the pressure of the coolant within the chamber.

According to a second aspect of the present disclosure, there is provided a flow controller for an engine cooling system, the flow controller comprising a chamber for receiving coolant flowing through the engine cooling system, a first inlet for coolant to flow into the chamber, a first valve for controlling the flow of coolant through the first aperture according to a pressure of the coolant to flow into the chamber through the first inlet, a second inlet for coolant to flow into the chamber, and a second valve for controlling the flow of coolant through the second aperture according to a pressure of the coolant to flow into the chamber through the second inlet.

According to a third aspect of the present disclosure, there is provided a flow controller for an engine cooling system, the flow controller comprising a chamber for receiving coolant flowing through the engine cooling system, a first aperture for coolant to flow into or out of the chamber, a first valve for controlling the flow of coolant through the first aperture according to a pressure of the coolant to flow through the first aperture, e.g. according to a pressure of the coolant within the chamber or within a cooling duct fluidically connected to the first aperture, a second aperture for coolant to flow into or out of the chamber, and a second valve for controlling the flow of coolant through the second aperture according to a pressure of the coolant to flow through the second aperture, e.g. according to a pressure of the coolant within the chamber or within a further cooling duct fluidically connected to the second aperture, wherein the first and second apertures are inlets, for coolant to flow into the chamber though the first and second apertures, or the first and second apertures are outlets, for coolant to flow out of the chamber though the first and second apertures.

The chamber may be configured to receive coolant from a coolant outlet of an engine housing.

The first and/or second valve may be a pressure relief valve. The chamber may comprise an inlet for receiving the coolant from the engine housing.

The first valve may be configured to open, in order to permit a flow of coolant through the first aperture, when the pressure of coolant to flow through the first aperture, e.g. within the chamber or within a cooling duct connected to the first aperture, is greater than or equal to a first pressure. The second valve may be configured to open, in order to permit a flow of coolant though the second aperture, when the pressure of coolant to flow through the second aperture, e.g. within the chamber or within a further cooling duct connected to the second aperture, is greater than or equal to a second pressure. The second pressure may be different from the first pressure. For example, the first pressure may be less than the second pressure. Alternatively, the first pressure may be greater than the second pressure. The first and second valves may comprise valve elements biased into closed positions by resilient elements, such as springs. Stiffnesses of the resilient elements may determine the pressures at which the respective valves open.

The flow controller may be mountable on the engine housing, e.g. such that the chamber is in fluidic communication with the coolant outlet of the engine housing or the coolant inlet of the engine housing. For example, the flow controller may be mountable to the engine housing at the cooling outlet or at the coolant inlet.

The flow controller may comprise a temperature sensor configured to determine a temperature of coolant within the chamber. The temperature sensor may be configured to provide a signal indicative of the determined temperature to a controller, e.g. of the engine cooling system or engine.

The flow controller further may further comprise one or more bleed channels for permitting coolant from the chamber to bleed past the first and/or second valves to flow through the first and/or second apertures respectively. The bleed channels may be defined in valve elements of the valves. For example, the bleed channels may comprise one or more openings formed in the valve elements permitting a bleed flow of coolant through the valves.

The flow controller may further comprise a third aperture for coolant to flow into or out of the chamber. For example, the flow controller may comprise a thirds outlet from the chamber or a third inlet into the chamber. The third aperture may be open. In other words, flow through the third aperture may be substantially unimpeded by any valve of the flow controller. The radiator may be fluidically coupled to the third aperture.

A cooling system for an engine may comprise an engine housing comprising a coolant inlet for coolant to enter the engine housing, a coolant outlet for coolant to leave the engine housing and one or more cooling passages extending between the coolant inlet and the coolant outlet, e.g. for coolant to pass through in order to cool the engine housing, and the above-mentioned flow controller, wherein the chamber of the flow controller is arranged to receive the coolant leaving the engine housing via the coolant outlet. Alternatively, the flow controller may be arranged in fluidic communication with the coolant inlet, e.g. to deliver coolant that has passed around the cooling system to the coolant inlet.

The cooling system may further comprise a pump for pumping coolant through the engine housing, e.g. through the cooling passages. The system may comprise an engine driven coolant pump, e.g. mechanically driven by the engine, for pumping the coolant though the engine housing. A pressure of coolant pumped by the engine driven coolant pump may vary according to a rotational speed of the engine.

Additionally or alternatively, the system may comprise an electrically driven coolant pump for pumping the coolant though the engine housing. The cooling system may further comprise a temperature sensor for demining a temperature of the cooling system, e.g. coolant within the engine housing, coolant within the chamber of the flow controller, or oil within or leaving the engine housing. The cooling system may be configured such that a pressure of coolant supplied by the electrically driven cooling pump varies according to the determined temperature. The temperature sensor may be the temperature sensor provided on the flow controller.

The cooling system may further comprise a controller configured to control the operation of the electrically driven cooling pump based on the determined temperature. The cooling system may be configured to control the electrically driven pump to supply coolant at a pressure greater than or equal to a first threshold pressure, at which the first valve opens, when the determined temperature is greater than or equal to a first threshold temperature.

The cooling system may be configured to control the electrically driven pump to supply coolant at a pressure less than a second threshold pressure, at which the second valve opens, when the determined temperature is less than a second threshold temperature.

The cooling system may be configured to control the electrically driven pump to supply coolant at a pressure greater than or equal to a second threshold pressure, at which the second valve opens, when the determined temperature is greater than or equal to a second threshold temperature.

The first outlet of the flow controller may be fluidically connected to one or more components of the engine within a first group of components. The second outlet of the flow controller may be fluidically connected to one or more components of the engine within a second group of components.

A desirable operating temperature of the components within the second group of components may be greater than a desirable operating temperature of the components within the first group of components. Additionally or alternatively a heat rejection rate or cooling requirement of the components within the second group of components may be less than a heat rejection rate or cooling requirement of the components within the first group of components. Additionally or alternatively again, a warm-up time, e.g. a time taken to reach desirable operating temperatures after the engine has been started, of the components within the second group of components may be greater than a warm-up time of the components within the first group of components.

The first outlet of the flow controller may be fluidically connected to a coolant inlet of the engine housing via a bypass line bypassing a radiator of the cooling system. The radiator may be connected to the third outlet of the flow controller.

The first outlet of the flow controller may be fluidically connected to cooling passages within a further engine housing. Additionally or alternatively, the first outlet of the flow controller may be fluidically connected to exhaust manifold cooling passages of the cooling system.

The cooling system may further comprise a thermostatic valve for controlling the flow of coolant flowing from the pressure vessel to a coolant inlet of the engine housing. The thermostatic valve may be provided between an outlet of the pressure vessel and a coolant inlet of the engine housing. For example, the thermostatic valve may be provided at the first outlet of the pressure vessel or at the coolant inlet. The thermostatic valve may be configured to control the flow of all of the coolant flowing from the pressure vessel to the coolant inlet. Alternatively, the thermostatic valve may be configured to control the flow of coolant through the radiator.

The thermostatic valve may be configured to direct the coolant through the bypass duct or the radiator, depending on the temperature of the coolant, e.g. depending on whether the thermostatic valve is open or closed.

The second outlet of the flow controller may be fluidically connected to a heater matrix of the vehicle. The second outlet of the flow controller may be fluidically connected to an oil cooler of the cooling system.

According to a fourth aspect of the present disclosure, there is provided a method for a cooling system of an engine, the cooling system comprising an engine housing comprising one or more cooling passages and a coolant outlet for coolant to leave the engine housing, and a flow controller comprising a chamber for receiving coolant flowing through the engine cooling system, a first aperture for coolant to flow into or out of the chamber, a first valve for controlling the flow of coolant through the first aperture according to a pressure of the coolant to flow through the first aperture, a second aperture for coolant to flow into or out of the chamber, and a second valve for controlling the flow of coolant through the second aperture according to a pressure of the coolant to flow through the second aperture, wherein the first and second apertures are inlets, for coolant to flow into the chamber though the first and second apertures, or the first and second apertures are outlets, for coolant to flow out of the chamber though the first and second apertures, wherein the method comprises supplying coolant to the chamber of the flow controller.

According to a fifth aspect of the present disclosure, there is provided a method for a cooling system of an engine, the cooling system comprising an engine housing comprising one or more cooling passages and a coolant outlet for coolant to leave the engine housing, and a flow controller comprising a chamber for receiving coolant flowing through the engine cooling system, a first inlet for coolant to flow into the chamber, a first valve for controlling the flow of coolant through the first aperture according to a pressure of the coolant to flow into the chamber through the first inlet, a second inlet for coolant to flow into the chamber, and a second valve for controlling the flow of coolant through the second aperture according to a pressure of the coolant to flow into the chamber through the second inlet, wherein the method comprises supplying coolant from the engine housing to the chamber of the flow controller.

According to a sixth aspect of the present disclosure, there is provided a method for a cooling system of an engine, the cooling system comprising an engine housing comprising one or more cooling passages and a coolant outlet for coolant to leave the engine housing, and a flow controller comprising a chamber for receiving coolant from the coolant outlet of the engine housing, a first outlet from the chamber, a first valve for controlling the flow of coolant from the chamber through the first outlet according to a pressure of the coolant within the chamber, a second outlet form the chamber, and a second valve for controlling the flow of coolant from the chamber through the second outlet according to the pressure of the coolant within the chamber, wherein the method comprises supplying coolant from the engine housing to the chamber of the flow controller.

The cooling system may further comprise a pump, e.g. an electrically driven pump. The method may further comprise determining a temperature of coolant the cooling system, e.g. within the engine and/or within the chamber of the flow controller.

The method may comprise operating the pump such that the pressure of coolant supplied by the pump is varied based on a temperature of the cooling system, e.g. a temperature of coolant within the chamber of the flow controller.

To avoid unnecessary duplication of effort and repetition of text in the specification, certain features are described in relation to only one or several aspects or embodiments of the invention. However, it is to be understood that, where it is technically possible, features described in relation to any aspect or embodiment of the invention may also be used with any other aspect or embodiment of the invention in particular, the features described in relation to any of the first, second and third aspects mentioned above, may be combined with the features of any of the other aspects, and the features described in relation to the fourth, fifth and sixth aspects mentioned above may be combined with the features of any of the other aspect.

With reference to FIG. 1, an engine assembly 2 for a vehicle comprises one or more engine housings, such as a cylinder block 10, and a cooling system 100 according to arrangements of the present disclosure. The engine housing(s) may comprise one or more cooling passages for coolant to circulate through, in order to cool the engine housings.

The engine assembly 2 may further comprise one or more components within a first group of engine components 20. The first group of engine components 20 may comprise a further engine housing, such as a cylinder head 22, an exhaust manifold 24 and/or a bypass duct 139 of the cooling system, described in more detail below.

The engine assembly 2 may further comprise one or more components within a second group of engine components 30. The second group of engine components may comprise an oil cooler 32. In some arrangements, the engine assembly 2 may further comprise one or more components within one or more further groups of engine components.

The engine components may be grouped according to warm-up and/or cooling demands of the engine components. For example, the engine components may be grouped based on how quickly the engine components reach their desirable operating temperatures after the engine has started, desirable operating temperatures or temperature ranges of the engine components, desirable cooling rates of the components and/or any other warm-up and/or cooling requirements of the engine components.

Each of the engine components may comprise one or more passages within or about the component through which coolant from the cooling system 100 can be circulated in order to cool the component and/or (for example, in the case of the oil cooler 32) transfer heat between the coolant and one or more other fluids within the component.

The cooling system 100 comprises a cooling pump 110 for pumping coolant to circulate around the cooling system. In the arrangement shown in FIG. 1, the cooling pump 110 is an engine driven cooling pump. The cooling pump 110 may be mounted on or within the engine housing 10 and may be driven by a shaft of the engine, such as a crankshaft. In some examples, additionally or alternatively, the cooling pump 110 may be driven by an electric motor, wherein the electric motor is further configured to partially propel the vehicle in a hybrid vehicle configuration.

The cooling pump 110 may be configured to pump the coolant arriving at a coolant inlet 12 of the engine housing 10 in order to pump the coolant though the cooling passages of the engine housing 10 to one or more coolant outlets 14 of the engine housing 10.

The cooling system 100 further comprises a radiator 120. Hot coolant within the cooling system may be circulated through the radiator 120 in order to reject heat to the environment surrounding the radiator 120.

The cooling system 100 further comprises a plurality of ducts for carrying coolant between the components of the cooling system 100 and/or engine assembly 2. In particular, the cooling system 100 may comprise one or more first supply ducts 132 for carrying coolant between the engine housing 10, e.g. the coolant outlet 14, and one or more components within the first group of engine components 20.

As depicted, two or more of the components within the first group of engine components 20, such as the cylinder head and exhaust manifold 24, may be connected in series with one another. Additionally or alternatively, one or more of the components within the first group of engine components 20, such as the bypass duct 139, may be connected in parallel with others of the components.

The cooling system 100 may further comprise one or more second supply ducts 134 for carrying coolant between the engine housing 10 and the one or more components in the second groups of engine components 30.

Two or more of the components within the second group of engine components 30 may be connected in series with one another. Additionally or alternatively, one or more of the components within the second group of engine components 30 may be connected in parallel with others of the components.

In some arrangements, the cooling system may further comprise one or more further supply ducts for carrying coolant between the engine housing 10 and one or more components within further groups of engine components. The further supply ducts and components within the further groups may be configured in the same way at the first and second supply duct and components in the first and second groups, as described above.

The cooling system 100 may further comprise a radiator supply duct 136 for carrying coolant between the engine housing 10, e.g. the outlet 14, and the radiator 120.

The coolant system 100 may further comprise one or more coolant return ducts 138, for carrying coolant from one or more of the engine components within the first, second and/or further groups of engine components 20, 30 and/or from the radiator 120 back to the coolant inlet 12 of the engine housing.

The cooling system 100 may further comprise a radiator flow valve 140 configured to control the flow of coolant through the radiator 120. The radiator flow valve 140 may be a thermostatically controlled valve configured to open to permit a flow of coolant through the valve when the temperature of the coolant within the cooling system, e.g. at the radiator flow valve 140, is above a first threshold temperature. Alternatively, the radiator flow valve 140 may comprise any other type of valve controlled in any other desirable manner.

As depicted, the radiator flow valve 140 may be provided on one of the supply ducts, 132, 134, such as the first supply duct. The radiator supply duct 136 may branch from one of the supply ducts 132, 134. In other words, the radiator flow valve 140 may control the flow of coolant from the one of the supply ducts 132, 134 to the radiator 120. In some arrangements, the radiator flow valve 140 may be configured to divert some or all of the coolant flowing through the supply duct into the radiator supply duct 136, e.g. to the radiator 120, when the radiator flow valve 140 is open.

In other arrangements, the radiator flow valve 140 may be provided on one of the return ducts 138 and the radiator supply duct 136 may branch from one of the return ducts 132, 134. In some arrangements, the radiator flow valve 140 may be configured to divert some or all of the coolant flowing through the return ducts into the radiator supply duct 126, e.g. to the radiator 120, when the radiator flow valve 140 is open.

The cooling system 100 may further comprise a bypass duct 139 for carrying coolant between the coolant outlet 14 to the coolant inlet 12 of the engine housing, e.g. to the coolant pump 110, bypassing the radiator 120. As mentioned above, the bypass duct 139 may be a component within the first group of engine components 20. The coolant may be carried from the coolant outlet 14 of the engine house to the bypass duct 139 via one of the first supply ducts 132.

The bypass duct 139 may branch from the coolant supply duct 132, 134 or the coolant return duct 138 at or downstream of the radiator flow valve 140, e.g. such that the bypass duct 139 is arranged in parallel with the radiator 120. In the arrangement shown, the bypass duct 139 is arranged in parallel with the other components in the first group of components 20. However, in other arrangements, the bypass duct 139 may be arranged in series with, e.g. downstream of, the other components in the first group of components, relative to a direction of coolant flow. For example, the bypass duct 139 may be provided between the first group of components 20 and the inlet 12 of the engine housing.

The cooling system 100 further comprises a flow controller 200 according to arrangements of the present disclosure. The flow controller 200 is configured to control the flow of coolant from the engine housing 10 to the first, second and optionally the further supply ducts 132, 134. In some arrangements, the radiator flow valve 140 may be provided as part of the flow controller 200. In such arrangements, the flow controller 200 may additionally control the flow of coolant from the outlet 14 to the radiator 120.

As depicted in FIG. 1, the flow controller 200 may be mounted on the engine housing 10, e.g. at the coolant outlet 14, in order to receive the coolant leaving the engine housing via the coolant outlet. Alternatively, the flow controller 200 may not be mounted on the engine housing 10 but may be otherwise fluidically connected to the coolant outlet 14 to receive the coolant, e.g. all of the coolant, leaving the engine housing 10.

Figure 2:
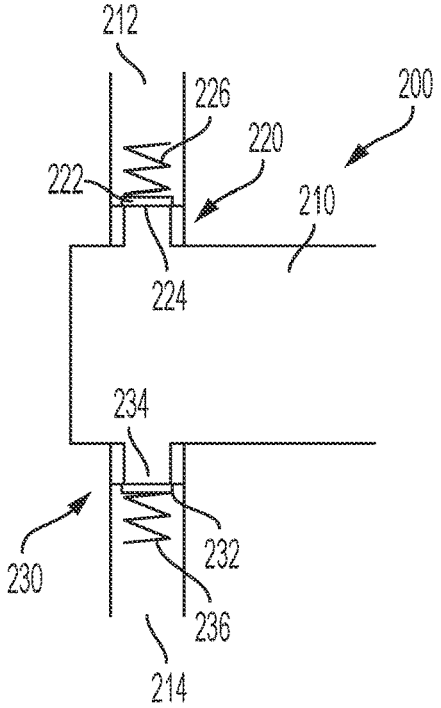
FIG. 2 shows a schematic view of a flow controller for the cooling system operating at low engine rpm.

With reference to FIG. 2, the flow controller 200 comprises a chamber 210 for receiving the coolant from the engine coolant outlet 14. The flow controller 200 comprises a first outlet 212 from the chamber 210 and a second outlet 214. The flow controller 200 further comprises a first valve 220 for controlling the flow of coolant through the first outlet 212 and a second valve 230 for controlling the flow of coolant through the second outlet 214.

The first and second valves 220, 230 may be pressure relief valves configured to open when the pressure within the chamber 210 is greater than or equal to first and second threshold pressures respectively.

As depicted in FIG. 2, the first and second valves 220, 230 each comprise a valve element 222, 232 for blocking an opening 224, 234 defined by the valve, in order to restrict a flow of coolant through the valve when the valve is in a closed configuration. The first and second valves each further comprise a resilient element 226, 236, such as a coil spring, for biasing the respective valve elements of the valves into closed positions, e.g. in which the valve element restricts flow through the opening defined by the valve.

The first and second valves 220, 230 are arranged such that the valve elements 222, 232 of the valves are exposed to the pressure of the coolant within the chamber 210. When the pressure force applied to the valve element of the first or second valve exceeds the force exerted by the spring of the particular valve, the valve element moves against the spring to permit a flow of coolant through the valve.

First and second threshold pressures, at which the first and second valves open respectively, may be different. For example, stiffnesses of the resilient elements 226, 236 of the first and second valves 220, 230 may be different from one another. In the arrangement depicted, the first pressure is less than the second pressure. However, in other arrangements, the second pressure may be less than the first pressure.

The first coolant supply ducts 132 of FIG. 1 may be coupled to the first outlet 212 of the chamber 210 for receiving the flow of coolant passing through the first outlet. The second coolant supply ducts 134 may be coupled to the second outlet of the flow controller for receiving the flow of coolant passing through the second outlet.

In some arrangements, the flow controller may comprise one or more further outlets and one or more further valves for controlling the flow of coolant through the further outlets, e.g. based on the pressure of coolant within the chamber 210. The further outlets and further valves may be configured in the same way as the first and second valves 220, 230. The pressure at which the further valves are configured to open may be different from the first and second valves or may be the same as either or both of the first and second valves. The one or more further supply ducts may be coupled to one or more further outlets of the chamber 210.

When the radiator flow valve 140 is provided as part of the flow controller 200, the radiator flow valve 140 may be arranged to control at least a portion of the flow of coolant passing through the first or second outlet. For example, the radiator flow valve 140 may be configured to control whether a portion of the flow of coolant passing through the first outlet 212 flows towards the radiator 120 or the bypass duct 139, e.g. depending on the temperature of the coolant.

In this way, the cooling system 100 is configured such that coolant is supplied to the components within the first group of components 20, and optionally the radiator 120, when the pressure of coolant in the chamber 210, e.g. leaving the engine outlet 14, is greater than or equal to the first threshold pressure, and coolant is supplied to the component within the second group of components 30 when the pressure of coolant within the chamber 210 is greater than or equal to the second threshold pressure.

In other arrangements, the radiator flow valve 140 may be configured to control the flow of coolant passing through one of the further outlets from the flow controller chamber 210.

As described above, in the arrangement shown in FIG. 1, the coolant pump 110 is an engine driven coolant pump. Accordingly, a pressure to which the coolant is pumped by the coolant pump 110 varies according to a running speed of the engine. The pressure of the coolant within the chamber 210 of the flow controller 220 therefore depends on the running speed of the engine.

As shown in FIG. 2, when the engine is running at a low running speed, e.g. less than 1500 revolutions per minute, the pressure of coolant within the chamber 210 may be less than the first and second threshold pressures. The first and second valves 220, 230 may therefore be closed. Accordingly, flow through the first supply ducts 132 and bypass duct 139, and through the second supply ducts 134 may be restricted by the first and second valves 220, 230 respectively.

Figure 3:
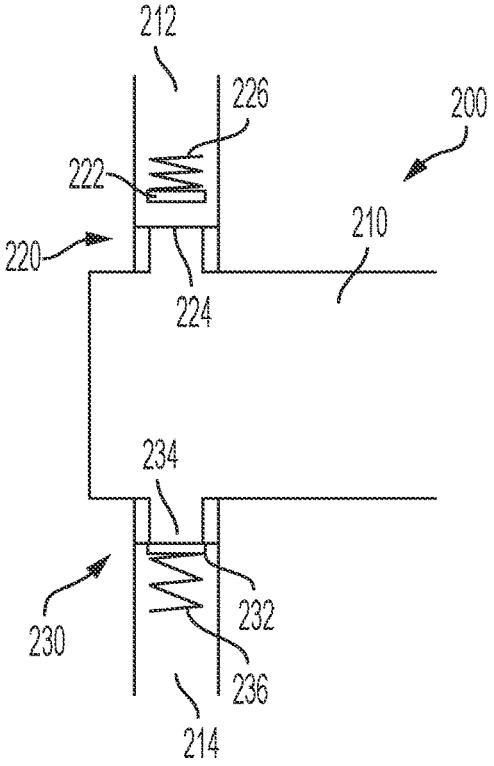
FIG. 3 shows a schematic view of a flow controller for the cooling system operating at mid-range engine rpm.

As shown in FIG. 3, when the engine is running at a mid-running speed, e.g. greater than or equal to 1500 revolutions per minute, such as between 1500 revolutions per minute (inclusive) and 2000 revolutions per minute (non-inclusive), the pressure of coolant within the chamber 210 of the flow controller 200 may be greater than or equal to the first threshold pressure and less than the second threshold pressure. Accordingly, the first valve 220 may be open and flow may be permitted though the first supply ducts 132 and optionally the radiator supply duct 136. However, the second valve 230 may be closed, and hence, flow through the second supply ducts 134 may be restricted by the second valve 230.

Figure 4:
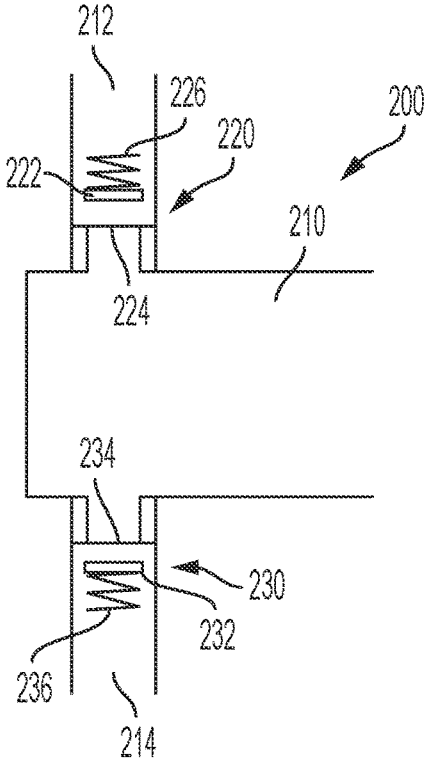
FIG. 4 shows a schematic view of a flow controller for the cooling system operating at high engine rpm.

As shown in FIG. 4, when the engine is running at a high running speed, e.g. greater than or equal to 2000 revolutions per minute, the pressure of coolant within the chamber 210 may be greater than the first threshold pressure and may be greater than or equal to the second threshold pressure. Accordingly, the first valve 220 may be open and flow may be permitted though the first supply ducts 132 and/or the radiator supply duct 136, and through the second supply ducts 134 of FIG. 1.

Figure 5:
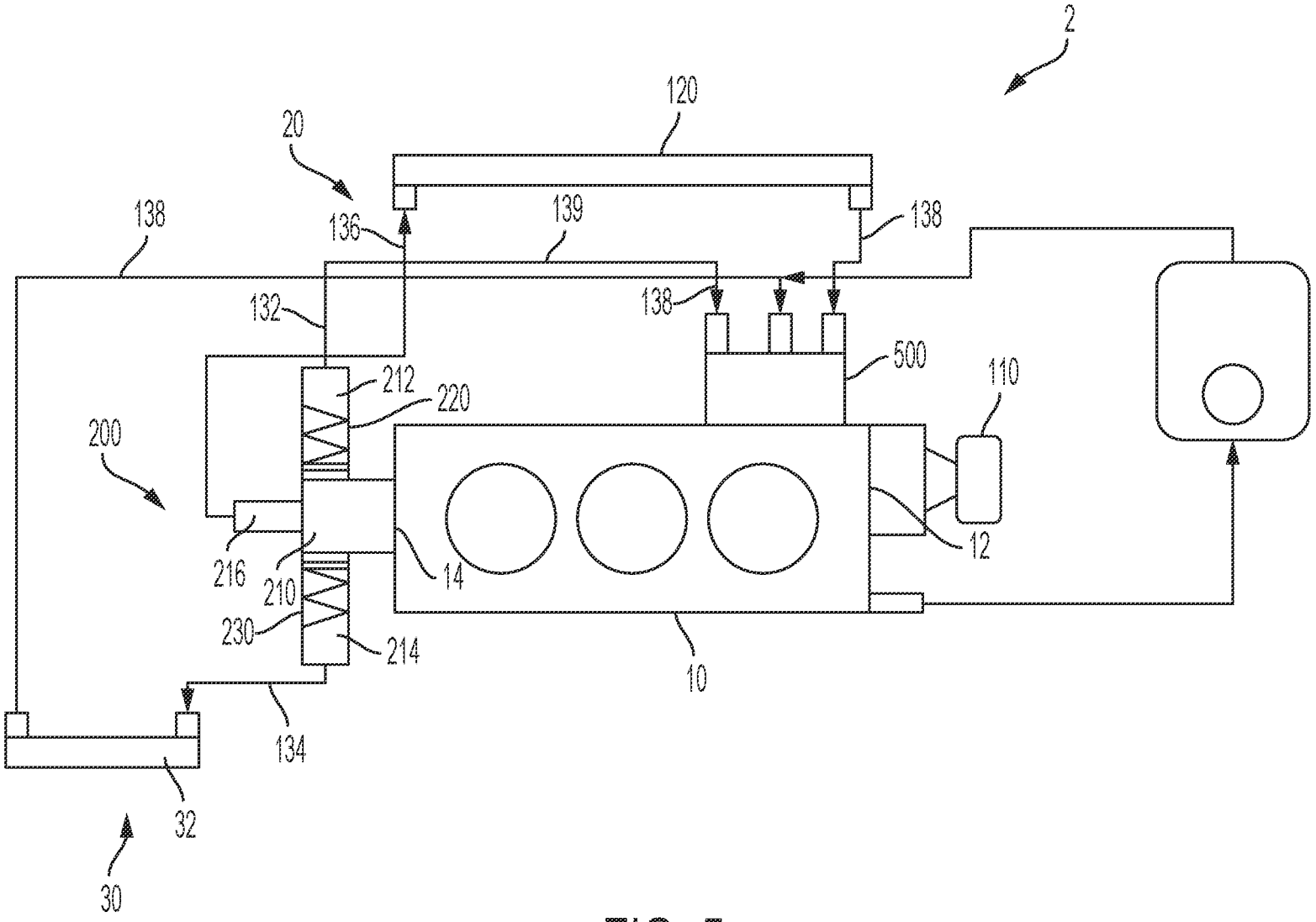
FIG. 5 shows a schematic view showing an engine assembly comprising a cooling system, according to another arrangement of the present disclosure.

With reference to FIG. 5, in another arrangement of the present disclosure, the cooling system 100 may comprise a thermostatic valve 500 for controlling the flow of coolant through the cooling system, e.g. through the first and second outlets 212, 214 of the flow controller 200 and optionally through one or more further outlets of the flow controller.

As shown, the thermostatic valve 500 may be provided at the inlet 12 of the engine housing 10. The thermostatic valve 500 may control the flow of coolant through each of the coolant return ducts 138 into the inlet. Accordingly, the thermostatic valve 500 may control the flow of coolant through each of the outlets of the flow controller 200.

In the arrangement shown in FIG. 5, the flow controller 200 comprises a third outlet 216. The radiator supply duct 136 is connected to a third outlet 216 of the flow controller. As depicted, the third outlet may be an open or unrestricted outlet. In other words, the further outlet may not comprise a valve. Hence, flow through the radiator 120 may be controlled by the thermostatic valve 500. In one example, the thermostatic valve 500 may be used in place of the radiator flow valve 140 of FIG. 1.

Figure 6:
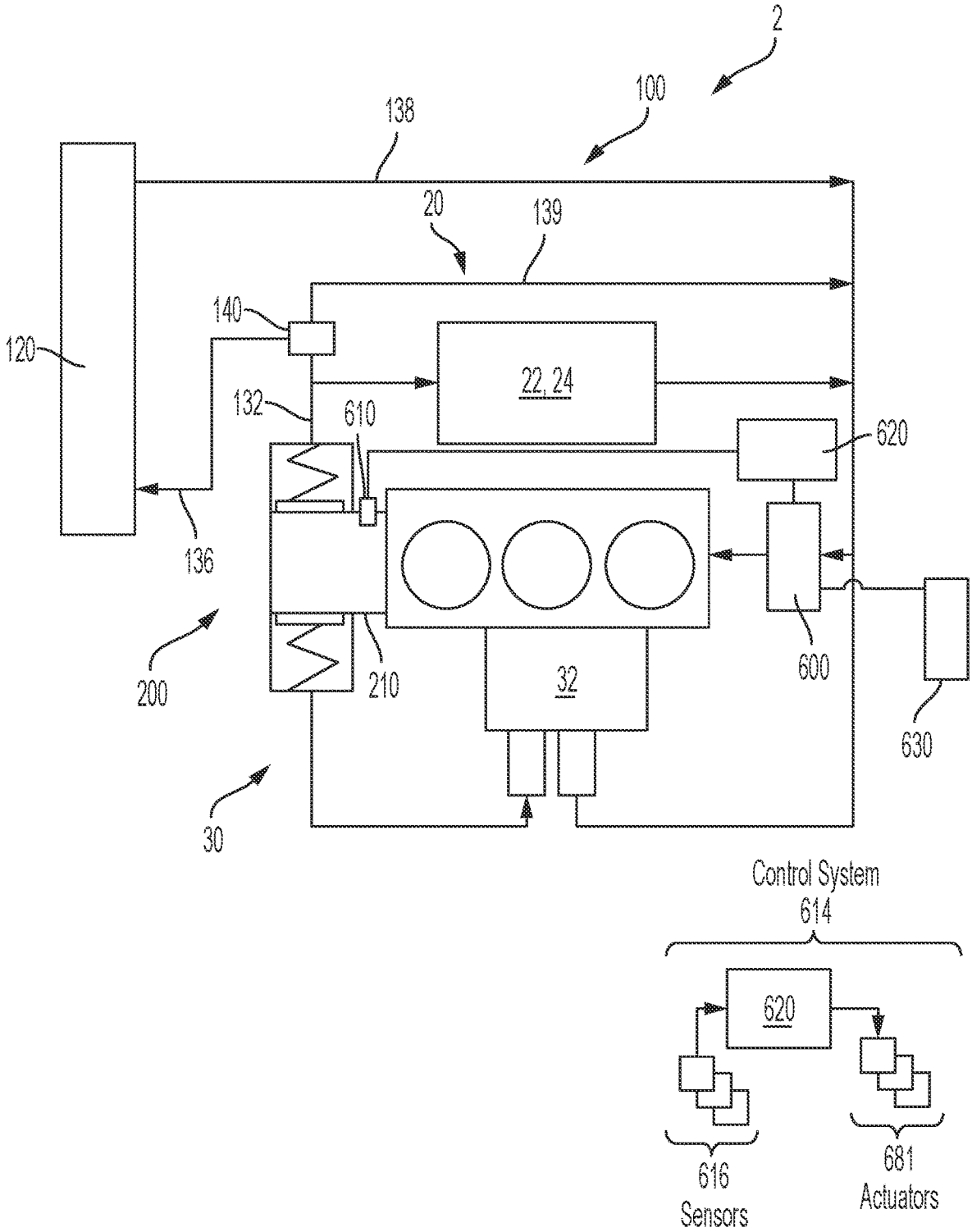
FIG. 6 shows a schematic view showing an engine assembly comprising a cooling system, according to another arrangement of the present disclosure.

With reference to FIG. 6, in another arrangement of the disclosure, the cooling system 100 may comprise an electrically operated coolant pump 600. The electrically driven coolant pump 600 may be provided in addition to or as alternative to the engine driven coolant pump 110.

The electrically driven coolant pump 600 may be operated independently of the running speed of the engine, and hence, the pressure of coolant being pumped through the engine housing 10 and arriving at the chamber 210 of the flow controller 200 may be substantially independent of the engine running sped.

As depicted in FIG. 6, the cooling system 110 may further comprise a temperature sensor 610 configured to determine a temperature of coolant within the cooling system. The temperature sensor 610 may be provided on the flow controller 200 for determining the temperature of the coolant within the chamber 210. Alternatively, the temperature sensor 610 may be provided on the engine housing 10 for determining the temperature within the engine housing, e.g. at the coolant outlet 14. Alternatively again, the temperature sensor 610 may be positioned at any other position in the cooling system.

The cooling system 100 may further comprise a controller 620 configured to control the operation of the cooling pump 600 based on the temperature of the coolant determined by the temperature sensor. In particular, the controller 620 may control the operation of the pump 600 such that the pressure to which the coolant is pumped by the pump varies according to the temperature of coolant within the cooling system.

The engine assembly 2 may further include control system 614. Control system 614 is shown receiving information from a plurality of sensors 616 (various examples of which are described herein) and sending control signals to a plurality of actuators 681 (various examples of which are described herein). As one example, sensors 616 may include temperature sensor 610. Other sensors such as additional pressure, temperature, air/fuel ratio, and composition sensors may be coupled to various locations in the engine assembly. As another example, the actuators may include the first valve 220 of the second valve 230.

Controller 620, which is part of control system 614, may be configured as a conventional microcomputer including a microprocessor unit, input/output ports, read-only memory, random access memory, keep alive memory, a controller area network (CAN) bus, etc. Controller 620 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines.

Figure 7:
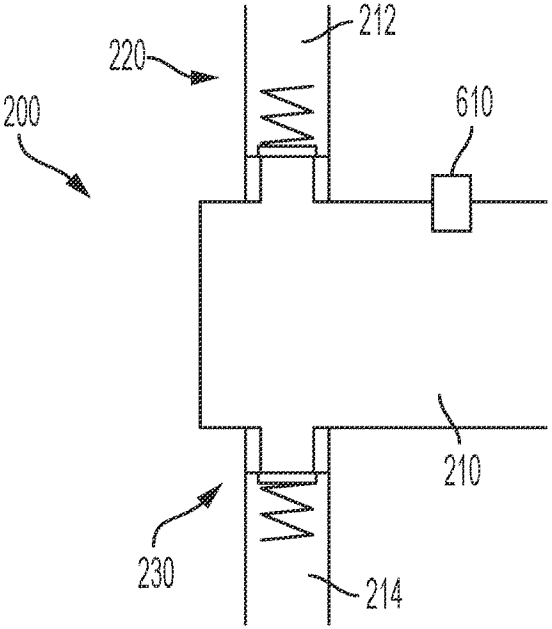
FIG. 7 shows a schematic view of a flow controller for the cooling system operating at low coolant temperature.

As shown in FIG. 7, when the temperature of coolant is below a first threshold temperature, such as less than 80° C., the controller 620 may operate the cooling pump 600 such that the pressure of coolant within the chamber 210 is less than the first and second pressures. The first and second valves 220, 230 may therefore be closed. Accordingly, flow through the first supply ducts 132, and through the second supply ducts 134 may be restricted by the first and second valves respectively. In one example, the coolant pressure is maintained below the first threshold pressure during a cold-start.

Figure 8:
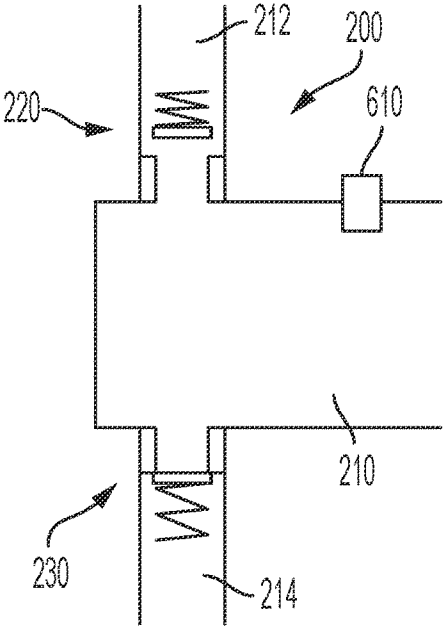
FIG. 8 shows a schematic view of the flow controller for the cooling system operating at mid coolant temperature.

As shown in FIG. 8 when the temperature of coolant is greater than or equal to the first threshold temperature, such as 80° C., and less than a second threshold, such as 90° C., the controller 620 may operate the cooling pump 600 such that the pressure of coolant within the chamber 210 is greater than or equal to the first pressure and less than the second pressure. Accordingly, the first valve 220 may be open and flow may be permitted though the first supply ducts 132. However, the second valve 230 may be closed and flow through the second supply ducts may be restricted by the second valve. In one example, the operation illustrated in FIG. 8 may be desired following the cold-start and outside of a high-load operating condition.

Figure 9:
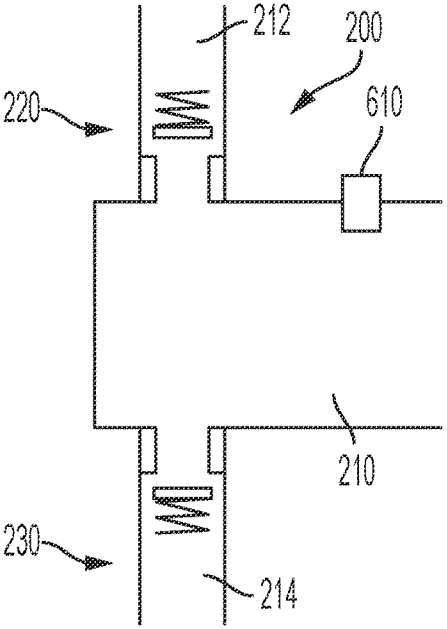
FIG. 9 shows a schematic view of the flow controller for the cooling system operating at high coolant temperature.

As shown in FIG. 9, when the temperature of coolant is greater than or equal to the first threshold temperature and greater than or equal to the second threshold temperature, e.g. 90° C., the controller 620 may operate the cooling pump 600 such that the pressure of coolant within the chamber is greater than or equal to the first pressure and greater than or equal to the second pressure. Accordingly, the first valve 220 may be open and flow may be permitted though the first supply ducts 132, and through the second supply ducts 134. In one example, the operation illustrated in FIG. 9 may be desired during a high-load, which may include a hard accelerator pedal tip-in.

The first and/or second valves 220, 230 may comprise respective bypass channels to permit coolant to bypass the valves. For example, openings may be formed in the valve elements of the valves for allowing a bleed flow of coolant through the valves. Hence, coolant may continue to flow from the engine into the chamber 210 when the first and second valves are closed. This may improve the rate at which the temperature sensor 610 is able to respond to changes in the temperature of coolant within the engine housing, when the temperature sensor is provided on the flow controller 200.

In the arrangements described above, the flow controller 200 is arranged such that coolant is supplied from the engine housing to the chamber 210, e.g. directly, and the first, second, and optionally further, valves 220, 230 control the flow of coolant flowing out of the chamber 210, e.g. via the first, second, and optionally further, outlets 212, 214. However, with reference to FIG. 10, in other arrangements, the valves 220, 230 may be arranged to control the flow of coolant into the chamber 210.

Figure 10:
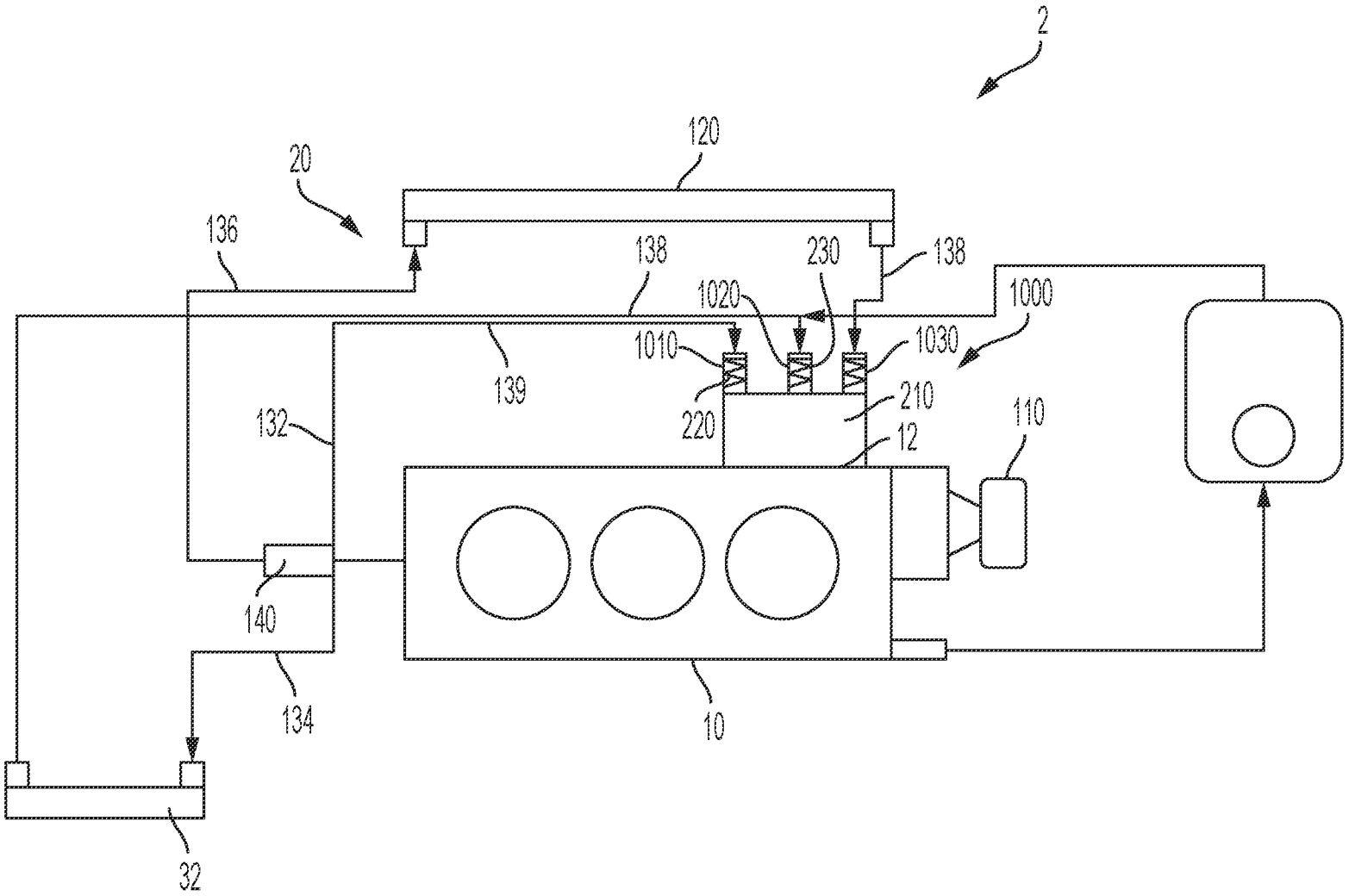
FIG. 10 shows a schematic view of showing an engine assembly comprising a cooling system according to another aspect of the present disclosure.

As depicted in FIG. 10, a flow controller 1000 may comprise a first inlet 1010 and a second inlet 1020. The flow controller 1000 may further comprise a further inlet, e.g. a third inlet 1030. The chamber 210 of the flow controller 1000 may be arranged in fluidic communication with the inlet 12 of the engine housing 10.

The first valve 220 may be arranged at the first inlet 1010 for controlling the flow of coolant through the first inlet, e.g. into the chamber 210. The first valve 220 may control the flow of coolant through the first inlet 1010 according to the pressure of coolant to flow through the first inlet.

The second valve 230 may be arranged at the second inlet 1020 for controlling the flow of coolant through the second inlet, e.g. into the chamber 210. The second valve 230 may control the flow of coolant though the second inlet 1020 according to the pressure of coolant to flow through the second inlet. The further valve or valves may be similarly arranged at respective ones of the further inlets, for controlling the flow of coolant through the further inlets.

As shown, the first, second and third inlets 1010, 1020, 1030 may be fluidically connected to different ones of the coolant return ducts 138. Accordingly, the first, second and further valves may be arranged to control the flow of coolant through each of the respective coolant return ducts 138 according to the pressure of the coolant within the respective coolant return ducts 138.

In this way, the flow controller 1000 may be configured to control the flow of coolant though the engine components within the first, second and further groups of engine components in the same way as the arrangements depicted in FIGS. 1 to 9 and described above. The features described above in relation to the engine assembly 2 and the flow controller 200 may also apply to the flow controller 1000 and the engine assembly in which it is installed.

In one example, the embodiment of FIG. 10 differs from the embodiments illustrated in FIGS. 1 and 6 in that the flow controller 1000 is mounted on an inlet side of the engine 10 and is configured to flow coolant to the inlet 12 of the engine. In one embodiment, the first inlet 1010 and the second inlet 1020 comprise respective valves configured to adjust coolant flow into the chamber 210 of the flow controller 1000 while a third inlet 1030 may be free of a valve such that coolant may flow uninterruptedly therethrough. Coolant in the chamber 210 may then flow through the inlet 12 and into coolant passages of the engine.

FIGS. 1-10 and 12 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Figure 11:
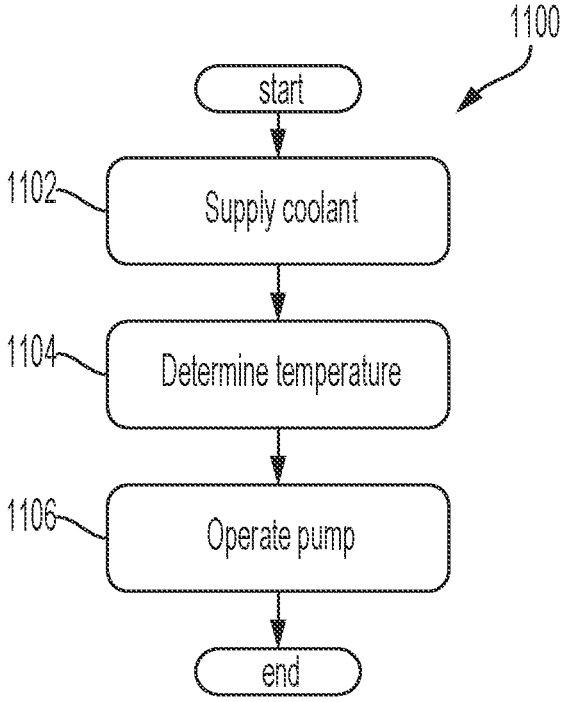
FIG. 11 shows a high-level flow chart illustrating a method of operating a cooling system according to the present disclosure.

With reference to FIG. 11, the cooling system 100 may be operated according to a method 1100 in conjunction with the high-level flow chart illustrated. The method comprises a first block 1102 at which coolant is supplied to the chamber 210 of the flow controller 200, 1000, e.g. from the engine housing.

The method 1100 may further comprise a second block 1104 at which a temperature of coolant the cooling system, e.g. within the engine and/or within the chamber of the flow controller, is determined.

The method 1100 may further comprise a third block 1106 at which the pump of the cooling system is operated such that the pressure of coolant supplied by the pump is varied based on the temperature of the cooling system.

The blocks of the method 1100 may be performed sequentially. Alternatively, one or more of the blocks may be performed at least partially simultaneously. When the cooling system comprises the engine drive cooling pump 200. The second and third blocks 1104, 1106 may be omitted from the method 1100.

Instructions for carrying out method 1100 and the rest of the methods included herein may be executed by a controller based on instructions stored on a memory of the controller and in conjunction with signals received from sensors of the engine system, such as the sensors described above with reference to FIG. 6. The controller may employ engine actuators of the engine system to adjust engine operation, according to the methods described below.

Figure 12:
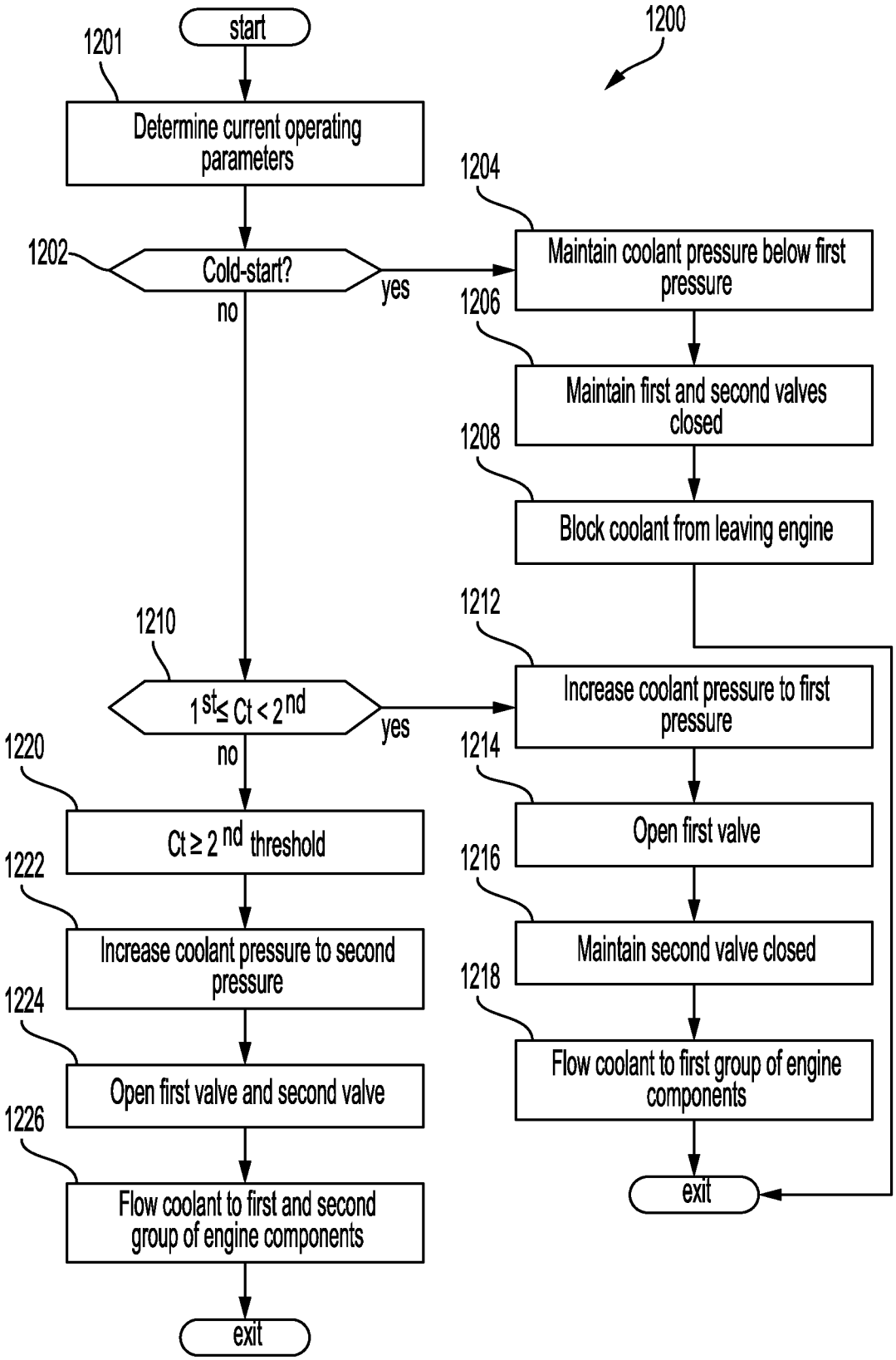
FIG. 12 shows a flow chart illustrating a method of adjusting a coolant pressure based on a coolant temperature.

Turning now to FIG. 12, it shows a method 1200 for operating a coolant pump via an electric motor. In one example, the method 1200 may be utilized for at least the embodiment illustrated in FIG. 6.

The method 1200 begins at 1201, which includes determining current operating parameters. Current engine operating parameters may include but are not limited to one or more of a throttle position, a manifold pressure, an engine speed, an engine temperature, a coolant temperature, a vehicle speed, and an air/fuel ratio.

The method 1200 may proceed to 1202, which includes determining if a cold-start is occurring. A cold-start may be occurring if a coolant temperature or an engine temperature is less than an ambient temperature. If a cold-start is occurring, then the method 1200 proceeds to 1204, which includes maintaining a coolant pressure below a first pressure. As such, the electric motor supplies an amount of power to a coolant pump actuator to allow the coolant pump to pump coolant to the engine while maintaining the coolant pressure below the first pressure.

The method 1200 may proceed to 1206, which includes maintaining the first and second valves closed.

The method 1200 may proceed to 1208, which includes blocking coolant from leaving the engine. As such, the coolant is blocked from flowing to the first and second group of engine components. In this way, the coolant flow is stagnant in the engine, which may allow engine heat to accelerate coolant heating and decrease a cold-start duration.

Returning to 1202, if the cold-start is not occurring or if the cold-start is complete, then the method 1200 may proceed to 1210, which includes determining if a coolant temperature is greater than or equal to a first threshold temperature and less than a second threshold temperature. If the coolant temperature is greater than or equal to the first threshold temperature and less than the second threshold temperature, then the method 1200 may proceed to 1212, which includes increasing a coolant pressure to a first pressure.

The method 1200 may proceed to 1214, which includes opening a first valve of the flow controller. In one example, the first valve may open in response to the coolant pressure being equal to or greater than the first pressure. Additionally or alternatively, the controller may signal to an actuator of the first valve to open the first valve.

The method 1200 may proceed to 1216, which includes maintaining a second valve of the flow controller closed.

The method 1200 may proceed to 1218, which includes flowing coolant to only the first group of engine components. As such, coolant does not flow to the second group of engine components when only the first valve is open. As described above, the first group of engine components comprises a cylinder head, an exhaust manifold and/or a bypass duct. Additionally or alternatively, a radiator may be included in first group of engine components. As such, the coolant may be further heated via the cylinder head or the exhaust manifold if desired. Additionally or alternatively, the coolant temperature may be maintained by flowing the coolant to the bypass duct and back to the engine. Additionally or alternatively, if cooling is desired, then the coolant may flow to the radiator via the open first valve. In one example, coolant flow to the radiator from the first duct may be adjusted via a radiator flow valve.

In one example of the method 1200, the cold-start may comprise a first stage and a second stage. The first valve and the second valve may be closed during the first stage (e.g., yes at 1202) so that coolant flow is stopped and heated in the engine. Once the first stage is complete (e.g., no at 1202) and the coolant temperature reaches a first threshold temperature, then the first valve may be opened and the coolant directed to the cylinder head and other components of the first group of engine components. By doing this, the coolant may be further heated and decrease a duration of the second stage of the cold-start.

Returning to 1210, if the coolant temperature is not greater than or equal to the first threshold temperature and less than the second threshold temperature, then the method 1200 proceeds to 1220, which includes determining that the coolant temperature is greater than or equal to the second threshold temperature. In one example, this may occur during a transient engine operating condition, such as a hard accelerator pedal tip-in. In another embodiment, the coolant temperature may be greater than or equal to the second threshold temperature in conjunction with a request for cooling.

The method 1200 proceeds to 1222, which includes increasing a coolant pressure to a second threshold pressure. In one example, the second threshold pressure is greater than the first threshold pressure. In one example, an amount of power supplied to the electric motor to drive the coolant pump to increase the coolant pressure to the second threshold pressure is greater than an amount of The method 1200 may proceed to 1224, which includes opening the first valve and the second valve.

The method 1200 may proceed to 1226, which includes flowing coolant to the first and second groups of engine components. The second group of engine components may comprise at least an oil cooler. In this way, engine coolant may thermally communicate with oil flowing through the oil cooler. In one example, the engine coolant may heat or cool the oil in the oil cooler.

Figure 13:
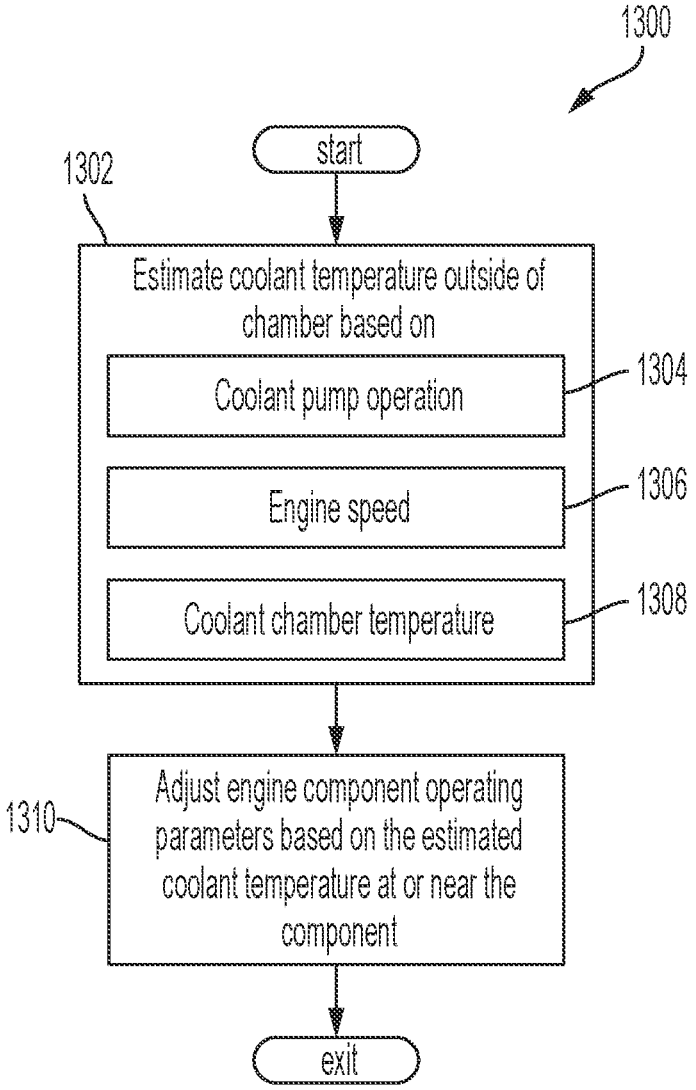
FIG. 13 shows a method for estimating a coolant temperature outside of the flow controller.

Turning now to FIG. 13, it shows a method 1300 for estimating a coolant temperature at a location of the coolant system without a temperature sensor. The estimated coolant temperature may optionally be used to adjust coolant operation and/or operation of an engine component.

The method 13002 begins at 1302, which includes estimating a coolant temperature outside of the chamber based on a coolant pump operation at 1304, an engine speed at 1306, and a coolant chamber temperature at 1308. The coolant pump operation 1304 may be determined based on one or more of the engine speed and a charge supplied to an actuator of the coolant pump. By determining a coolant pump operation, an estimation of where coolant is flowing may be determined. In one example, the coolant pump may be determined to be pressurizing coolant to a first pressure, resulting in coolant flowing to only the first group of engine components via the first valve being open and not flowing to the second group of engine components due to the second valve remaining closed. Additionally, the coolant chamber temperature 1308, which is sensed by the temperature sensor arranged in the chamber, may be used to estimate an operation of the pump along with the coolant temperature at various portions of the coolant system.

The method 1300 may proceed to 1310, which includes adjusting engine component cooperating parameters based on the estimated coolant temperature at or near the component. For example, the method may estimate a coolant temperature at the cylinder head, the exhaust manifold, and the oil cooler. Flow of coolant through the cylinder head, the exhaust manifold, or the oil cooler may be adjusted in response coolant temperature. As one example, if the coolant temperature at the cylinder head is greater than a desired operating temperature, then operation of the coolant pump may be adjusted to increase coolant flow to the oil cooler. As another example, if the coolant temperature at the oil cooler is greater than the desired operating temperature, then oil flow to the oil cooler may be adjusted (e.g., increased or decreased) and/or coolant pump operation may be adjusted to decrease the coolant pressure.

In this way, a pressure device fluidly coupled to an outlet of an engine may be configured to decrease a cold-start duration without electric valves or actuators. The pressure device may utilize a coolant pressure defined by an engine rotation per minute. The technical effect of configuring the pressure device to operate based on the coolant pressure is to avoid electric valves, clutched water pumps, and other similar devices that are expensive and demand calibration. The pressure device of the present disclosure comprises a first valve that opens at a first coolant pressure and a second valve to open at a second coolant pressure. Each of the valves may comprise a small opening, such as a bleed-through hole, to avoid a completely zero flow event, thereby allowing a small amount of coolant to flow to a thermostat while still block a majority of coolant from exiting the pressure device.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A flow controller for an engine cooling system, the flow controller comprising:

a cooling pump mounted to an engine housing adjacent to an inlet of the engine cooling system, the cooling pump fluidly coupled to cooling passages of the engine;

a chamber for receiving coolant flowing through the engine cooling system, wherein the chamber is mounted directly to and directly contacting the engine housing adjacent to an outlet of the engine cooling system;

a first aperture configured to flow coolant out of the chamber;

a first valve configured to adjust coolant flow through the first aperture based on a coolant pressure;

a second aperture configured to flow coolant out of the chamber; and a second valve configured to adjust coolant flow through the second aperture based on the coolant pressure, wherein the first valve is configured to open in response to the coolant pressure being greater than a first pressure and less than a second pressure, and wherein the second valve is configured to open in response to the coolant pressure being greater than a second pressure, wherein the second pressure is greater than the first pressure.

2. The flow controller of claim 1, wherein the flow controller comprises a temperature sensor configured to determine a temperature of coolant within the chamber.

3. The flow controller of claim 1, wherein the flow controller further comprises one or more bleed channels configured to allow coolant from the chamber to bleed past the first and second valves when the first and second valves are in fully closed positions.

4. The flow controller of claim 1, wherein the flow controller further comprises a third aperture configured to allow coolant to flow into the chamber, wherein flow through the third aperture is substantially unimpeded by any valve of the flow controller.

5. The flow controller of claim 4, wherein the third aperture is fluidly coupled to the outlet.

6. A cooling system for an engine, the cooling system comprising:

an engine housing comprising a coolant inlet for coolant to enter the engine housing, a coolant outlet for coolant to leave the engine housing and one or more cooling passages extending between the coolant inlet and the coolant outlet;

a cooling pump mounted adjacent to the coolant inlet and fluidly coupled to cooling passages of the engine; and a flow controller comprising a chamber in fluidic communication with the cooling system, wherein the flow controller is mounted directly to and directly contacting the engine housing.

7. The cooling system of claim 6, wherein the cooling pump is an electrically driven coolant pump for pumping the coolant though the engine housing.

8. The cooling system of claim 7, wherein the cooling system further comprises a temperature sensor configured to sense a coolant temperature in the flow controller, wherein a pressure of coolant supplied by the electrically driven coolant pump is adjusted in response to the coolant temperature.

9. The cooling system of claim 8, wherein the cooling system further comprises a controller with computer-readable instructions stored on non-transitory memory thereof that when executed enable the control to signal to an actuator of the electrically driven coolant pump to adjust the pressure of coolant in response to the coolant temperature.

10. The cooling system of claim 9, wherein the instructions enable the controller to signal to the actuator of the electrically driven coolant pump to supply coolant at a pressure greater than a first threshold pressure, at which the first valve opens, when the coolant temperature is greater than a first threshold temperature.

11. The cooling system of claim 10, wherein the instructions enable the controller to signal to the actuator of the electrically driven coolant pump to supply coolant at a pressure greater than a second threshold pressure, at which the second valve opens, when the coolant temperature is greater than a second threshold temperature, wherein the second threshold temperature is greater than the first threshold temperature.

12. The cooling system of claim 6, wherein a first aperture of the flow controller coupled to the first valve is fluidically connected to one or more components of the engine within a first group of components including a cylinder head and an exhaust manifold.

13. The cooling system of claim 12, wherein a second aperture of the flow controller coupled to the second valve is fluidically connected to one or more components of the engine within a second group of components including at least an oil cooler.

14. The cooling system of claim 13, wherein the first aperture of the flow controller is fluidically connected to a bypass line bypassing a radiator of the cooling system.

15. The cooling system of claim 13, wherein the first aperture and the second aperture are configured to flow coolant directly to an inlet of the engine.

16. The cooling system of claim 13, wherein the first aperture and the second aperture are configured to receive coolant directly from an outlet of the engine.

17. A cooling system of an engine, the cooling system comprising:

an engine housing comprising a coolant inlet for coolant to enter the engine housing, a coolant outlet for coolant to leave the engine housing and one or more cooling passages extending between the coolant inlet and the coolant outlet; and a flow controller mounted directly to and directly contacting the engine housing, the flow controller comprising:

a chamber for receiving coolant flowing through the cooling system;

a first aperture for coolant to flow out of the chamber;

a first valve for controlling the flow of coolant through the first aperture based on a coolant pressure;

a second aperture for coolant to flow out of the chamber;

a second valve configured to adjust coolant flow through the second aperture based on the coolant pressure, wherein the first valve is configured to open in response to the coolant pressure being greater than a first pressure and less than a second pressure, and wherein the second valve is configured to open in response to the coolant pressure being greater than a second pressure, wherein the second pressure is greater than the first pressure; and a controller comprising computer-readable instructions stored on non-transitory memory thereof that when executed enable the controller to signal to an actuator of an electrically driven coolant pump to adjust a coolant pressure in response to a coolant temperature, wherein the coolant temperature is sensed by a temperature sensor in the chamber, wherein the electrically driven coolant pump is mounted directly to the coolant inlet of the engine housing and configured to adjust a pressure of coolant flowing to cooling passages of the engine to adjust a position of one or more of the first valve and the second valve.

18. The cooling system of claim 17, wherein the instructions enable the controller to signal to the actuator to adjust the coolant pressure to less than a first pressure in response to the coolant temperature being less than a first threshold temperature, and wherein the instructions enable the controller to signal to the actuator to adjust the coolant pressure to greater than or equal to the first pressure and less than a second pressure in response to the coolant temperature being greater than or equal to the first threshold temperature and less than a second threshold temperature, and wherein the instructions enable the controller to signal to the actuator to adjust the coolant pressure to greater than or equal to the second pressure in response to the coolant temperature being greater than the second threshold temperature.

19. The cooling system of claim 18, wherein the coolant pressure is adjusted to a pressure less than the second pressure in response to a cold-start, and wherein coolant only exits the chamber via the first aperture when the coolant pressure is less than the second pressure and greater than or equal to the first pressure.

* * * * *